US006564837B1

(12) United States Patent
Lou

(10) Patent No.: US 6,564,837 B1
(45) Date of Patent: May 20, 2003

(54) PROCESS FOR PREPARING BAMBOO TIMBER

(75) Inventor: Dea-Ji Lou, Dong Guan (CN)

(73) Assignee: Wei Rong Dong Guan Bamboo & Wood Products Co., Ltd. (CN)

( * ) Notice: Subject to any disclaimer, the term of this patent is extended or adjusted under 35 U.S.C. 154(b) by 0 days.

(21) Appl. No.: 10/125,195

(22) Filed: Apr. 18, 2002

(51) Int. Cl.[7] ..... B27D 1/00

(52) U.S. Cl. ..... 144/350; 144/43; 144/346; 144/369; 144/3.1; 144/329

(58) Field of Search ..... 144/344, 345, 144/346, 363, 350, 369, 43, 1.1, 3.1, 329; 428/106, 107

(56) References Cited

U.S. PATENT DOCUMENTS

| | | | | | |
|---|---|---|---|---|---|
| 3,643,710 | A | * | 2/1972 | Fitzgibbon | 144/3.1 |
| 5,143,792 | A | * | 9/1992 | Cramer et al. | 144/350 |
| 6,192,949 | B1 | * | 2/2001 | Nien | 144/350 |
| 6,321,863 | B1 | * | 11/2001 | Nien | 144/350 |

* cited by examiner

*Primary Examiner*—W. Donald Bray
(74) *Attorney, Agent, or Firm*—Jackson Walker L.L.P.

(57) ABSTRACT

A process for preparing bamboo timber has steps of slicing a bamboo into bamboo ribbons, combining the bamboo ribbons to form a bamboo cylinder, shaving the bamboo cylinder into bamboo foil, and removing irregular sides of the bamboo foil.

8 Claims, 3 Drawing Sheets

PROCESS FOR PREPARING BAMBOO TIMBER

BACKGROUND OF THE INVENTION

1. Field of the Invention

The present invention relates to a process, and more particularly to a process for preparing bamboo timber, wherein a bundle of elongated bamboo pieces are securely combined together to form a bamboo cylinder and then the bamboo cylinder is further processed to become a bamboo foil that can be made into a product.

2. Description of Related Art

Bamboo is a kind of grass which has a faster growing cycle than a tree. Furthermore, bamboo has better wear resistance than many types of wood. Due to its cheapness, bamboo has been used for thousands of years to make homes and articles for the home and land, however in recent times people have start using bamboo to make different household appliances because it is preferable to the destruction of more slowly growing trees. CN patent (The Peoples Republic of China) 87100368 discloses a method for making laminated bamboo timber, which uses a bamboo as the material. The inner and outer knots on the bamboo are removed and the bamboo is boiled. After the bamboo is boiled, the bamboo is immersed in wax and then two different softening steps are implemented to the waxed bamboo which is then pressed. Thereafter, the bamboo is sliced and dried. Thus, the bamboo timber is ready for the user to make a product, such as a floor, a veneer, or a core in a finished product.

Another CN patent, 91108203, teaches a new method for making bamboo timber, which comprises boiling, softening, spreading and pressing steps. Yet, another CN patent, 89204604, uses a different approach to make the bamboo timber. The steps in this patent include cutting the bamboo into sections, cutting the bamboo sections into elongated bamboo ribbon, smoothing sides of the bamboo ribbons, adding chemicals to the smoothed bamboo ribbons to make the bamboo ribbons become woodworm proof, fungus proof and moisture proof, and combining the elongated bamboo ribbons.

None of the techniques described above requires no large machinery and capitals, which is too costly, complex and non-cost effective. The mentioned techniques are highly labor-intensive and so, with the increase in labor costs, even in developing countries, the efficiency of machine production is not achieved.

To overcome the shortcomings, the present invention tends to provide an improved process to mitigate and obviate the aforementioned problems.

SUMMARY OF THE INVENTION

The primary objective of the present invention is to provide a process to make bamboo timber, which is easy and cost effective.

In order to accomplish the foregoing objective, the process for preparing bamboo timber of the present invention has the steps of:

slicing a bamboo into bamboo ribbons;

combining the bamboo ribbons to form a bamboo cylinder; and shaving the bamboo cylinder into bamboo sheet.

Other objects, advantages and novel features of the invention will become more apparent from the following detailed description when taken in conjunction with the accompanying drawings.

DETAILED DESCRIPTION OF THE PREFERRED EMBODIMENT

Figure 1:
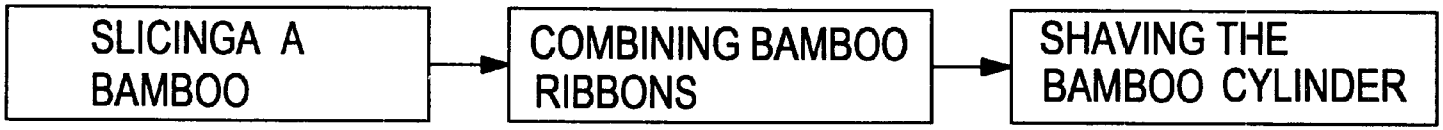
FIG. 1 is a schematic flow chart showing the process of the present invention.

With reference to FIG. 1, the process in accordance with the present invention for preparing bamboo timber has the steps of:

slicing a bamboo into bamboo ribbons;

combining the bamboo ribbons to form a bamboo cylinder; and shaving the bamboo cylinder into bamboo foil.

Figure 2:
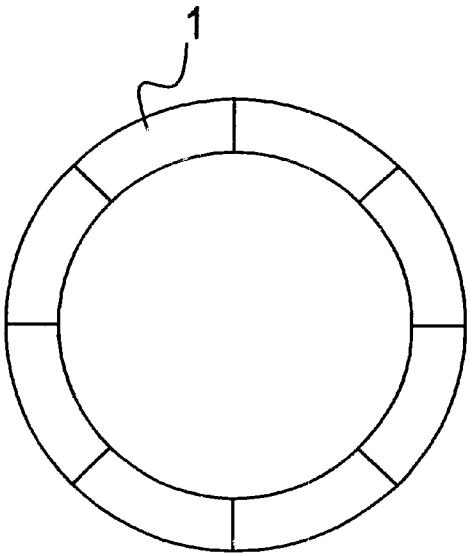
FIG. 2 is an end view showing a first embodiment of the invention to form a bamboo ribbon.
Figure 3:
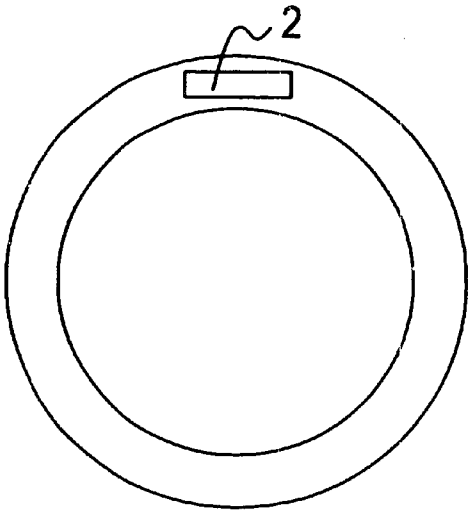
FIG. 3 is an end view showing a second embodiment of the invention to form a bamboo ribbon.

With reference to FIGS. 2 and 3, the slicing bamboo step is able to be accomplished by directly slicing the bamboo, which is cylindrical in shape, to bamboo ribbons (1) all at once, as shown in FIG. 2, or slicing the bamboo into bamboo ribbons (2) one by one, as shown in FIG. 3.

Figure 4:
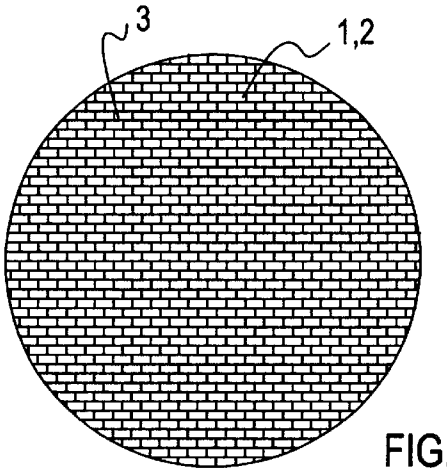
FIG. 4 is an end view showing the bamboo ribbons are combined to form a bamboo cylinder.
Figure 5:
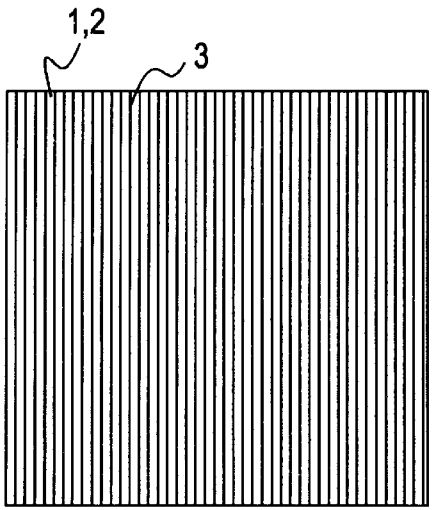
FIG. 5 is a side view showing a side face of the bamboo cylinder in FIG. 4.

With reference to FIGS. 4 and 5, after the bamboo ribbons (1,2) are formed, the user combines the bamboo ribbons (1,2) into a bamboo cylinder (3) by gluing the bamboo ribbons (1,2) together.

Figure 6:
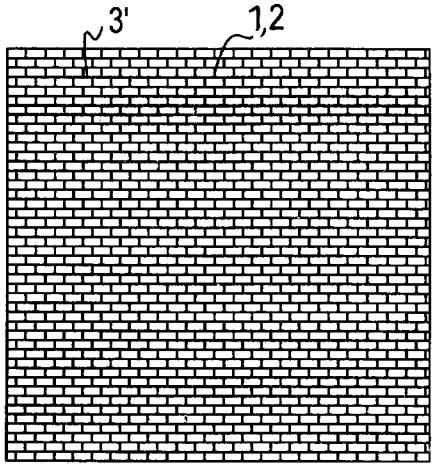
FIG. 6 is an end view showing the bamboo ribbons are combined to form a cube.
Figure 7:
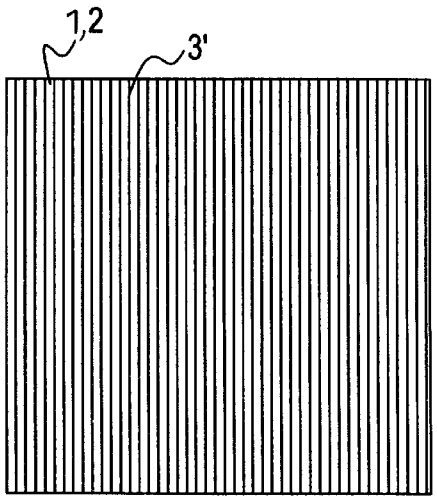
FIG. 7 is a side view showing a side face of the bamboo cube.

Another embodiment of the invention is shown in FIGS. 6 and 7, wherein after the bamboo ribbons (1,2) are formed, the user combines the bamboo ribbons (1,2) into a bamboo cube (3') by gluing the bamboo ribbons (1,2) together.

Figure 8:
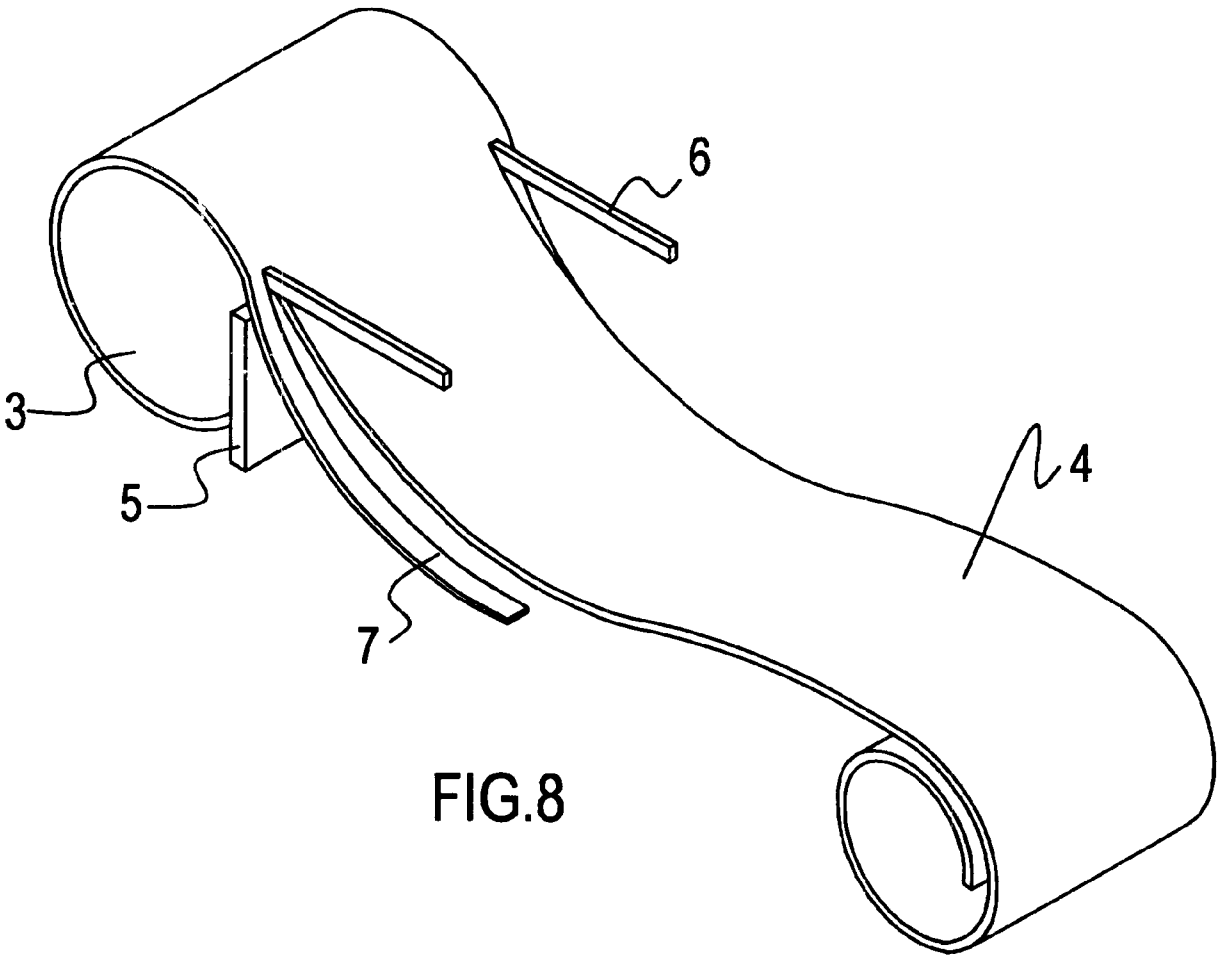
FIG. 8 is a schematic view showing that the bamboo cylinder is sliced into bamboo foil so as to be ready for further use.

When the bamboo cube (3') is formed, the user shaves the bamboo cubic cylinder (3) on a machine which has a shaver (5) to shave the bamboo cylinder (3) into bamboo foil (4) and two side shavers (6) each on opposite sides of the shaver (5) to remove irregular sides (7) of the bamboo foil (4), as shown in FIG. 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A process for preparing bamboo timber comprising the steps of:

slicing a bamboo trunk into bamboo ribbons;

combining the bamboo ribbons to form a bamboo cylinder; and shaving a periphery of the bamboo cylinder into a bamboo foil.

2. The process as claimed in claim 1, wherein the bamboo ribbons are formed by cutting the bamboo directly so as to form the bamboo ribbons simultaneously.

3. The process as claimed in claim 1, wherein the bamboo ribbons are formed one by one.

4. The process as claimed in claim 1 further comprising a step of removing irregular sides of the bamboo foil after the bamboo cylinder periphery shaving step.

5. The process as claimed in claim 2 further comprising a step of removing irregular sides of the bamboo foil after the bamboo cylinder periphery shaving step.

6. A process for preparing bamboo timber comprising the steps of:

slicing a bamboo trunk into bamboo ribbons;

combining the bamboo ribbons to form a bamboo cylinder;

shaving a periphery of the bamboo cylinder into bamboo foil; and removing irregular sides of the bamboo foil.

7. The process as claimed in claim 6, wherein the bamboo ribbons are formed by cutting the bamboo directly so as to form the bamboo ribbons simultaneously.

8. The process as claimed in claim 6, wherein the bamboo ribbons are formed one by one.

* * * * *